US008926133B2

(12) United States Patent
Booth

(10) Patent No.: US 8,926,133 B2
(45) Date of Patent: Jan. 6, 2015

(54) SYSTEM, METHOD, AND APPARATUS FOR DISSIPATING HEAT FROM A LED

(71) Applicant: LumaStream, Inc., St. Petersburg, FL (US)

(72) Inventor: Christopher Douglas Booth, Saint Petersburg, FL (US)

(73) Assignee: LumaStream, Inc., St. Petersburg, FL (US)

( * ) Notice: Subject to any disclaimer, the term of this patent is extended or adjusted under 35 U.S.C. 154(b) by 0 days.

(21) Appl. No.: 13/968,521

(22) Filed: Aug. 16, 2013

(65) Prior Publication Data

US 2014/0071679 A1 Mar. 13, 2014

Related U.S. Application Data

(60) Provisional application No. 61/700,374, filed on Sep. 13, 2012.

(51) Int. Cl.
*F21V 29/00* (2006.01)

(52) U.S. Cl.
CPC ..... *F21V 29/22* (2013.01)
USPC ..... 362/249.02; 362/382

(58) Field of Classification Search
USPC ..... 362/249.02, 500, 249.03, 384, 394, 362/364; 313/498
See application file for complete search history.

(56) References Cited

U.S. PATENT DOCUMENTS

| | | | |
|---|---|---|---|
| 5,738,436 | A | 4/1998 | Cummings et al. |
| 6,511,209 | B1 | 1/2003 | Chiang |
| 7,455,430 | B2 | 11/2008 | Huang |
| 7,670,021 | B2 | 3/2010 | Chou |
| 7,780,315 | B2 | 8/2010 | Gasquet et al. |
| 7,824,075 | B2 | 11/2010 | Maxik |
| 7,988,336 | B1 | 8/2011 | Harbers et al. |
| D646,011 | S | 9/2011 | Rashidi |
| 8,070,328 | B1 | 12/2011 | Knoble et al. |
| D654,205 | S | 2/2012 | Rashidi |
| D658,802 | S | 5/2012 | Chen |
| D659,878 | S | 5/2012 | Rashidi |
| D659,879 | S | 5/2012 | Rashidi |
| 8,177,397 | B1 | 5/2012 | Knoble et al. |
| 8,197,098 | B2 | 6/2012 | Cook |
| 8,237,381 | B2 | 8/2012 | Harbers et al. |

(Continued)

FOREIGN PATENT DOCUMENTS

| | | | |
|---|---|---|---|
| CA | 2666561 | A1 | 11/2010 |
| CN | 201297545 | Y | 8/2009 |

(Continued)

*Primary Examiner* — Tracie Y Green

(74) *Attorney, Agent, or Firm* — Larson & Larson, P.A.; Frank Liebenow; Patrick Reid

(57) ABSTRACT

A lighting system includes a base that is made of a thermally conductive material. Mounted within a cavity in the base and thermally interfaced to the base is a device that produces light (LED or LED array). Heat produced by the device that produces light conducts from the device to the base. A removable bezel is connected to the base along a conical frustum interface. The interface is formed at an angle with respect to a lengthwise axis of the bezel such that heat from the base conducts through the conical frustum interface and to the bezel from which the heat is radiated into the room ambient environment. An extension of the bezel includes an optional trim preferably made of the same or a similar material.

22 Claims, 4 Drawing Sheets

(56) References Cited

U.S. PATENT DOCUMENTS

| | | | | |
|---|---|---|---|---|
| 8,240,871 | B2 | 8/2012 | Chou | |
| 2003/0048632 | A1* | 3/2003 | Archer | 362/101 |
| 2003/0209343 | A1 | 11/2003 | Bingler | |
| 2008/0037255 | A1 | 2/2008 | Wang | |
| 2008/0165535 | A1* | 7/2008 | Mazzochette | 362/294 |
| 2008/0285271 | A1* | 11/2008 | Roberge et al. | 362/235 |
| 2008/0298045 | A1 | 12/2008 | Wright | |
| 2009/0135608 | A1 | 5/2009 | Sell | |
| 2009/0147517 | A1 | 6/2009 | Li et al. | |
| 2010/0061108 | A1* | 3/2010 | Zhang et al. | 362/364 |
| 2010/0270903 | A1 | 10/2010 | Jao et al. | |
| 2011/0069501 | A1 | 3/2011 | Chou et al. | |
| 2011/0075414 | A1 | 3/2011 | Van De Ven et al. | |
| 2011/0084586 | A1 | 4/2011 | Lain et al. | |
| 2011/0110095 | A1* | 5/2011 | Li et al. | 362/294 |
| 2011/0267828 | A1* | 11/2011 | Bazydola et al. | 362/373 |
| 2012/0001563 | A1 | 1/2012 | Rimmer et al. | |
| 2012/0182744 | A1 | 7/2012 | Santiago et al. | |
| 2012/0206926 | A9 | 8/2012 | Chou | |

FOREIGN PATENT DOCUMENTS

| | | | |
|---|---|---|---|
| CN | 101749682 | A | 6/2010 |
| CN | 201496851 | U | 6/2010 |
| CN | 201715394 | U | 1/2011 |
| CN | 201748237 | U | 2/2011 |
| CN | 201748293 | U | 2/2011 |
| CN | 201935005 | U | 8/2011 |
| CN | 201964272 | U | 9/2011 |
| EP | 2476946 | A1 | 7/2012 |
| KR | 101044453 | B1 | 6/2011 |
| KR | 20110113909 | A | 10/2011 |
| KR | 20120000662 | U | 2/2012 |
| KR | 20120030489 | A | 3/2012 |
| MX | 2010005479 | A | 11/2010 |
| TW | 200844368 | A | 11/2008 |
| TW | M350660 | U | 2/2009 |
| TW | 200928184 | A | 7/2009 |

* cited by examiner

SYSTEM, METHOD, AND APPARATUS FOR DISSIPATING HEAT FROM A LED

FIELD

This invention relates to the field of lighting and more particularly to a system for dissipating heat from LED lighting systems.

BACKGROUND

Since the days of Edison, the incandescent light has filled many a homes and businesses with safe, convenient, and affordable illumination. Incandescent light bulbs produce light by a flow of an electric current through a filament and thereby heating the filament to a very high temperature. The filament is prevented from oxidizing or burning by encapsulating the filament within a vacuum or within an inert gas formed within a glass enclosure that allows the light to exit while preventing introduction of air/oxygen around the filament. Since the filament normally operates at extremely high temperatures, there was little need in the past to cool filament-based lighting systems.

The advances in high powered light emitting diode (LED) efficacies have exceeded incandescent and halogen light sources resulting in rapidly increasing adoption for general illumination applications. LEDs are semiconductor devices, in which, the forward biased flow of electrons across a P-N semiconductor junction produces light. LEDs are much more efficient than incandescent bulbs because more of the energy consumed by the LED is converted into light as opposed to heat (as is the case with incandescent lighting). An added benefit of LED lighting is that LEDs last much longer than incandescent lights, requiring less frequent replacement. The long life offsets an initially higher cost to produce LEDs. Typically, LEDs have lifetimes of 50,000 hours or more when operated at around 25° C.

LED light output (or flux) is measured in lumens. Led light output and reliability are dependent upon temperature, a common characteristic for all LEDs. As LED case temperatures and corresponding junction temperatures increase, light output decreases and reliability typically decreases. Therefore, proper thermal management of the LEDs is critical to minimize the reduction in light output and maintain the expected reliability of the LEDs. Furthermore, because LEDs are semiconductors, they have a limited operating temperature range and will fail or have limited life if operated above that temperature.

For many applications, LEDs fit in well, replacing incandescent equivalents without significant problems. Applications where there is sufficient air flow often provide sufficient cooling to properly operate LED based incandescent replacement bulbs because the ambient room air temperature is typically what is comfortable to people, between 60° F. to 80° F. Applications such as in a table lamp provide a reasonable ambient room air temperature for operation of an LED-replacement bulb.

There are many applications where the ambient temperature is much higher than 60° F. to 80° F., creating problems with cooling the LEDs. One such example is in overhead recessed lighting (e.g. "Can Lights" or "Top Hats"). Such lighting is often recessed above a ceiling with little or no air circulation from the room below. In such cases, the heat sinks used to cool the LEDs are often located within the un-cooled space between the ceilings and next floor of a building or directly below an attic and often covered with insulation. In such cases, the air space around the heat sink is dead air space with typical ambient temperatures that often exceed 60° C. (140 F). These heat issues were less of a problem with incandescent light bulbs that are designed to operate in such high temperatures. However, these heat issues are critical issues for LED lighting.

To permit operation of LED lighting in recessed lighting, manufacturers have resorted to including extra-large heat sinks to channel heat away from the LEDs. Such heat sinks help, but due to the typical dead air space temperatures, these heat sinks are not sufficient solutions for many applications. Furthermore, there are limitations on the size of such heat sinks due to the typical space above the ceiling and installation spaces such as the hole size through which the recessed lighting must pass during installation.

Typical LED recessed lighting applications resort to large and heavy heat sinks to transfer heat from the LED junctions. Numerous light fixture applications exist where the heat sink is designed to be located in relatively high ambient temperatures of the dead space which are greater than room temperatures. Room temperatures are typically in the range of 18° C. to 26° C., but dead air spaces typically reach temperatures of anywhere from 40° C. to 60° C. Flow of heat from the LED junctions, through the heat sinks, and out to the surrounding air depends upon the temperature differential between the junction temperature and the temperature of the surrounding air. For example, if the junction temperature is 60° C. and the surrounding air temperature is also 60° C., no heat will flow and no heat will be dissipated.

LED recessed down lights are often enclosed within a can enclosure which is in turn installed in a ceiling in commercial buildings. In such cases, dead air space exists between the next floor and a dropped ceiling constraining the heat flow from heat sinks. Similarly, in residential applications, LED recessed down lights are often installed in ceilings below an attic. In these attic locations, an insulation layer often surrounds the recessed down lights, further reducing the heat flow from LED loads to the air above the insulation layer.

What is needed is a LED heat sink system that will dissipate sufficient heat such that the LEDs will operate within their specified temperature ranges in ceiling lighting systems.

SUMMARY

A lighting system includes a base that is manufactured of a thermally conductive material. Mounted within a cavity of the base and thermally interfaced to the base is a device that produces light (LED or LED array). Heat produced by the device that produces light conducts from the device to the base. A removable bezel is connected to the base along a conical frustum interface. The interface is formed at an angle with respect to a lengthwise axis of the bezel such that heat from the base conducts through the conical frustum interface and to the bezel from which the heat is radiated into the room ambient environment. An extension of the bezel includes an optional trim preferably made of a similar material. The trim and bezel are fabricated as a single part or separate parts that are bonded or fastened together.

In one embodiment, a lighting system is disclosed including a base that is formed of a material that conducts heat and having a device for producing light. The device for producing light is mounted to the base and is thermally interfaced to the base allowing heat to be conducted from the device to the base. The lighting system has a bezel connected to the base along a conical frustum interface. The conical frustum interface is formed at an angle with respect to a lengthwise axis of the bezel such that heat from the base efficiently conducts through the conical frustum interface and into the bezel and the heat is radiated from the bezel into room ambient air.

In another embodiment, a lighting system is disclosed including a base that is formed of a material that conducts heat and having one or more light emitting diodes (LEDs) mounted to the base. The light emitting diode(s) are thermally interfaced to the base allowing heat to be conducted from the light emitting diode(s) to the base. A bezel is connected to the base along a conical frustum interface. The conical frustum interface is formed at an angle with respect to a lengthwise axis of the bezel such that heat from the base conducts through the conical frustum interface and into the bezel and the heat is then radiated from the bezel into room ambient air surrounding the bezel.

In another embodiment, method of dissipating heat from the prior lighting system is disclosed including, the method including providing the lighting system as described prior and providing power to the light emitting diode(s), thereby the light emitting diode(s) produce both light and heat from the power. At least some of the heat from the light emitting diodes is conducted to the base, and consequently, at least some heat from the base is conducted to the bezel through the conical frustum interface. The heat is then conducted and/or radiated from the bezel into the room ambient air surrounding the bezel.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
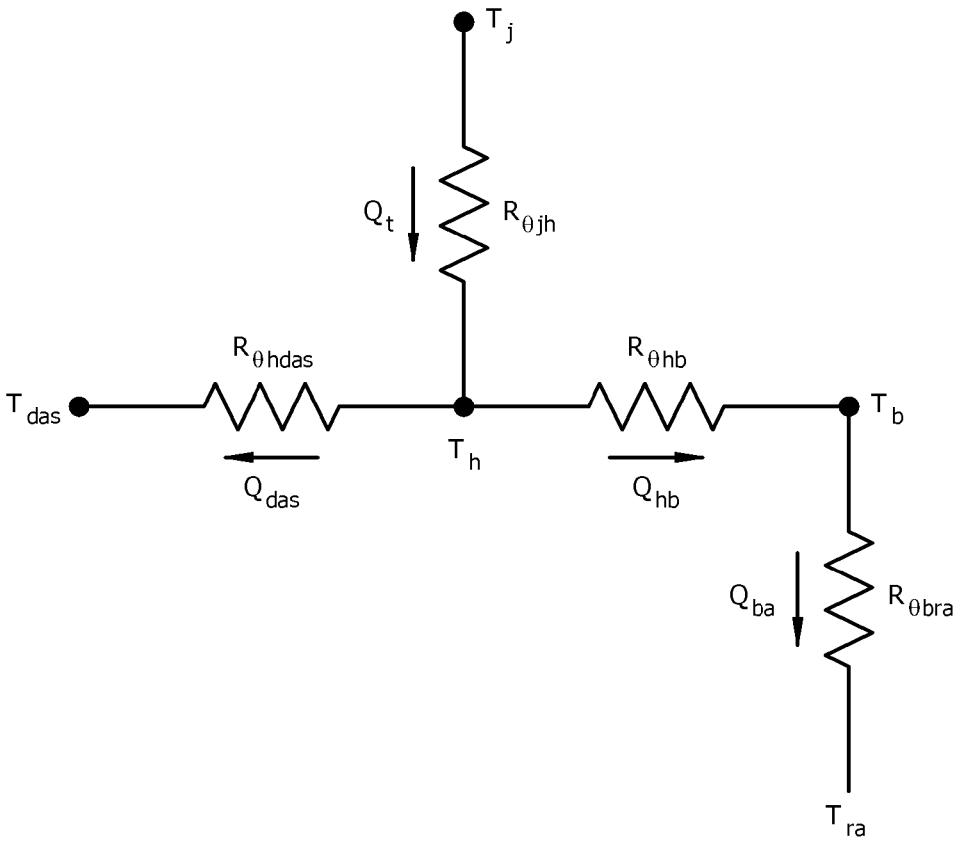
FIG. 1 illustrates a simplified thermal schematic of a typical LED lighting system.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a simplified thermal schematic of a typical LED lighting system is shown. This schematic is for a typical thermal circuit showing the heat flow from a LED or LED array to the air space above and below a ceiling. Note, for simplicity, this schematic does not include heat conducted into the ceiling tiles and/or wiring system, etc.

An LED array is defined as a group of series and/or parallel electrically connected LEDs mounted on a single platform such as but not limited to a metal core circuit board.

This thermal schematic of FIG. 1 shows the heat flow $Q_T$ which is driven by temperature gradients where heat flows from higher temperatures to cooler temperatures. $Q_T$ is related to the power dissipation of the LED (or LEDs) 30 (see FIGS. 3-5) which has a junction temperature $T_j$, typically required to be in the range of less than 85° C. Assuming the heat sink has a lower temperature $T_h$ than the junction temperature $T_j$, heat flow $Q_T$ is from the junction to the heat sink through a thermal resistance $R\Theta_{jh}$. The thermal resistance $R\Theta_{jh}$ is due to the interface between each individual LED 30 semiconductor junction and the heat sink, including typically plastic packaging and electrical leads from the semiconductor device.

Now, assuming that the heat sink has a higher temperature $T_h$ than the dead air space, Tdas, a portion of the total heat flow, $Q_T$, will flow from the heat sink to the dead air space $Q_{das}$, limited by the efficiency (or thermal resistance) of the heat sink denoted by $R\Theta_{hdas}$. Such efficiencies are factors of the surface area of the heat sink and the temperature differential between the heat sink $T_h$ and the dead air space Tdas.

The remaining portion of the heat flow $Q_T$ flows from the heat sink through the bezel to the room ambient air $T_{ra}$. It is assumed that most of the heat transfer to ambient air is accomplished by natural convection cooling. The ability to transfer heat from the heat sink to the ambient air is affected by temperature differences between the heat sink temperature, $T_h$, and the temperature of the room ambient air, $T_{ra}$. Typically, ceiling lighting systems have bezels 20/120 (see FIGS. 2 and 3) that are exposed to room ambient air and, therefore, will transfer heat from the bezels 20/120 to the room ambient air, assuming the temperature of the bezel, $T_b$, is greater than the temperature of the room ambient air, $T_{ra}$.

The flow of heat from the heat sink to the bezel is not absolute and is limited by the interface/connection between the heat sink and the bezel, denoted $R\Theta_{hb}$, Likewise, the ability for heat to flow from the bezel to the room ambient air is also limited by the design of the bezel, taking into account the material of the bezel, color, surface area, etc. This is denoted by $R\Theta_{bra}$.

Therefore, the total heat dissipation (or flow) is limited by the amount of heat that flows from the heat sink into the dead space (above the ceiling) plus the amount of heat that flows from the heat sink into the ambient air, represented by the formulas:

$$1)\ Q_{hb} = Q_{ba}$$

$$2)\ Q_T = Q_{das} + Q_{ba}$$

$$3)\ Q_{das} = \frac{T_h - T_{das}}{R\ \Theta_{hdas}}$$

$$4)\ Qhb = \frac{Th - Tra}{(R\ \Theta_{hb} + R\Theta_{bra})}$$

The thermal resistance from heat sink $T_h$ to room ambient air $T_{ra}$ includes the interface resistance between the heat sink and bezel $R\Theta_{hb}$ and the interface resistance between the bezel and the room ambient air, $R\Theta_{bra}$. The division of heat flow QT between $Q_{das}$ and $Q_{ra}$ is dependent on the temperature gradients to each air location $T_{das}$ for the dead air and $T_{ra}$ for the room air, as well as thermal resistances $R\Theta_{hdas}$ and $R\Theta_{hb}$+$R\Theta_{bra}$.

Note that the thermal resistance $R\Theta_{jh}$ includes the thermal resistance from the LED junction to the case of the LED array 30 plus the thermal resistance from the LED case to the heat sink.

In recessed down light applications, heat sink size is often limited not only to weight but also to size. Height is typically limited by the space above the ceiling and diameter is limited by existing lighting standard sizes, where typical recessed down light diameters are limited to 4 inch, 5 inch, and 6 inch diameter sizes, etc. The size and weight for the heat sink limits the efficiency of heat transfer from the heat sink to the dead air space, $R\Theta_{hdas}$, and due to the often low expected temperature differentials between the heat sink and the dead air space, the heat sink alone is often not sufficient to properly cool the LED or LED array 30.

Most recessed down lights include a bezel 20/120. Bezels not only provided a decorative look but also covered the interface between the ceiling material 40 (see FIGS. 2 and 3) and the ceiling fixture. Since an outer surface area of the bezel 20/120 is surrounded by room ambient air, which is typically cooler than dead air space, it is advantageous to use the bezel to transfer at least some of the heat from the LED or LED array 30 into the room ambient air.

Figure 2:
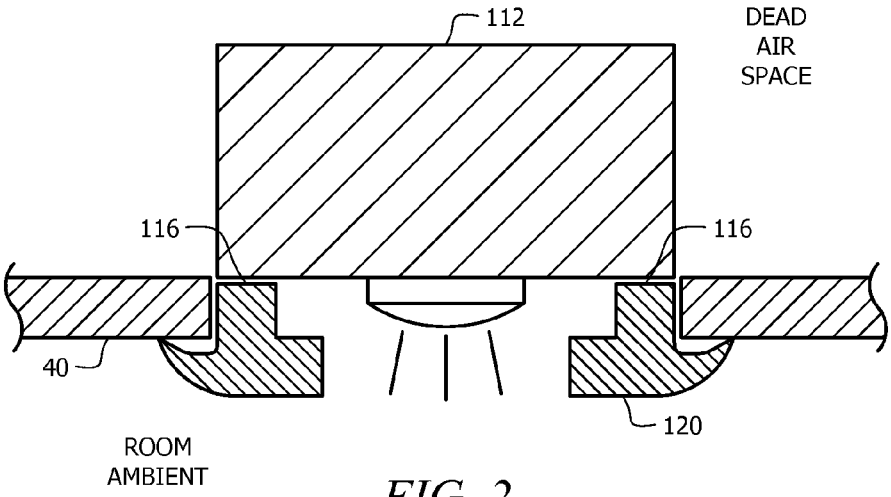
FIG. 2 (Prior Art)
FIG. 2 illustrates a cross-sectional view of a LED lighting system of the prior art.

Referring to FIG. 2, a cross-sectional view of a LED lighting system of the prior art is shown. Given the recessed down light size constraints, the heat sink 112 typically must fit within a specific size hole in the ceiling 40. The bezel 120 has an opening for allowing light to pass and results in a horizontal annular ring surface area interface 116 where the bezel 120 contacts the heat sink 112. Although this approach provides for transfer of some heat from heat sink 112 to the bezel 120 and, therefore, to room ambient air, the limited surface area of the interface 116 where the bezel 120 contacts the heat sink 112 results in a high thermal resistance $R\Theta_{hb}$-2, limiting heat flow $Q_{hb}$-2 and $Q_{ba}$-2 from the heat sink 112 to room air ambient $T_{ra}$. In this example, the contact area 116 between the bezel 120 and the heat sink 112 does not provide optimal heat transfer. Assuming flow of heat to the dead air space is constant, $Q_{das}$-2, total heat flow $Q_t$-2 from the LED or LED array is reduced due to this higher thermal resistance through this low-efficiency interface 116, $R\Theta_{hb}$-2.

Figure 3:
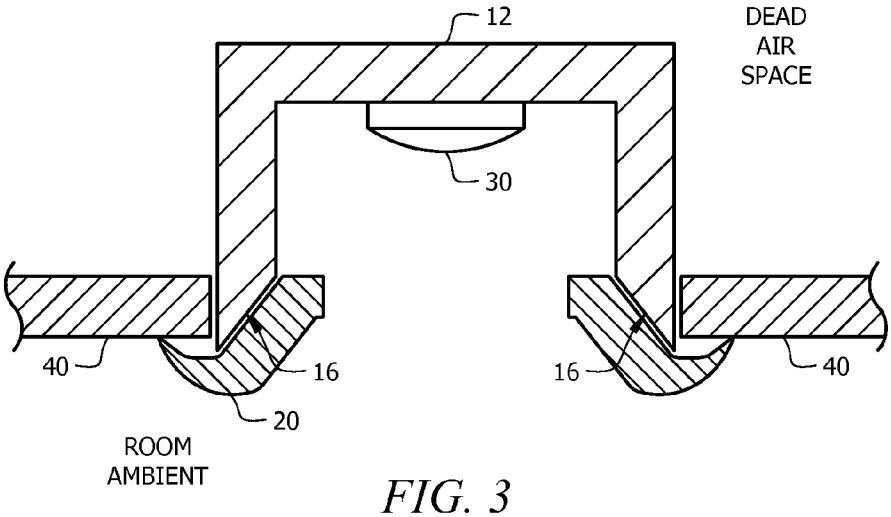
FIG. 3 illustrates a cross-sectional view of a new LED lighting system.

Referring to FIG. 3, a cross-sectional view of a new LED lighting system is shown. In this, the surface area 16 where the bezel 20 contacts the heat sink 12 is in the form of a conical frustum (see FIG. 6). This approach provides for a greater transfer of heat from heat sink 12 to the bezel 20 and, therefore, to room ambient air, by providing an increased surface area of the interface 16 where the bezel 20 contacts the heat sink 12, resulting in a lower thermal resistance $R\Theta_{hb}$-3 as compared to $R\Theta_{hb}$-2 of the prior art. This results in a greater heat flow $Q_{hb}$-3 and $Q_{ba}$-3 from the heat sink 12 to room air ambient $T_{ra}$ compared to that of the prior art shown in FIG. 2. The conical frustum interface 16 between the bezel 20 and the heat sink 12 provides greater heat transfer given the size constraints of the bezel 20 and the heat sink 12. Since $R\Theta_{hb}$-2 is greater than $R\Theta_{hb}$-3 (greater thermal resistance in the prior art) and assuming flow of heat to the dead air space in both scenarios is constant ($Q_{das}$-2=$Q_{das}$-3), total heat flow from the LED or LED array $Q_t$-3 in the system of FIG. 3 is greater than total heat flow $Q_t$-2 in the system of FIG. 2. The improved total heat flow provides for lower LED and LED array junction temperatures over a wider range of ambient room air temperatures and dead air space temperatures; resulting in improved operation and life of the LED or LED array.

Figure 4:
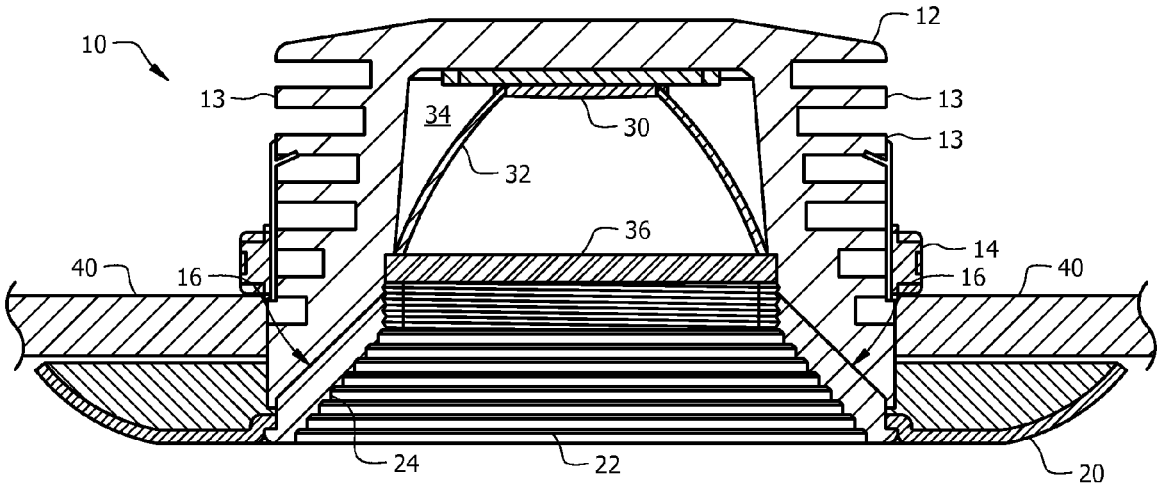
FIG. 4 illustrates a cross-sectional view of the new LED lighting system.
Figure 5:
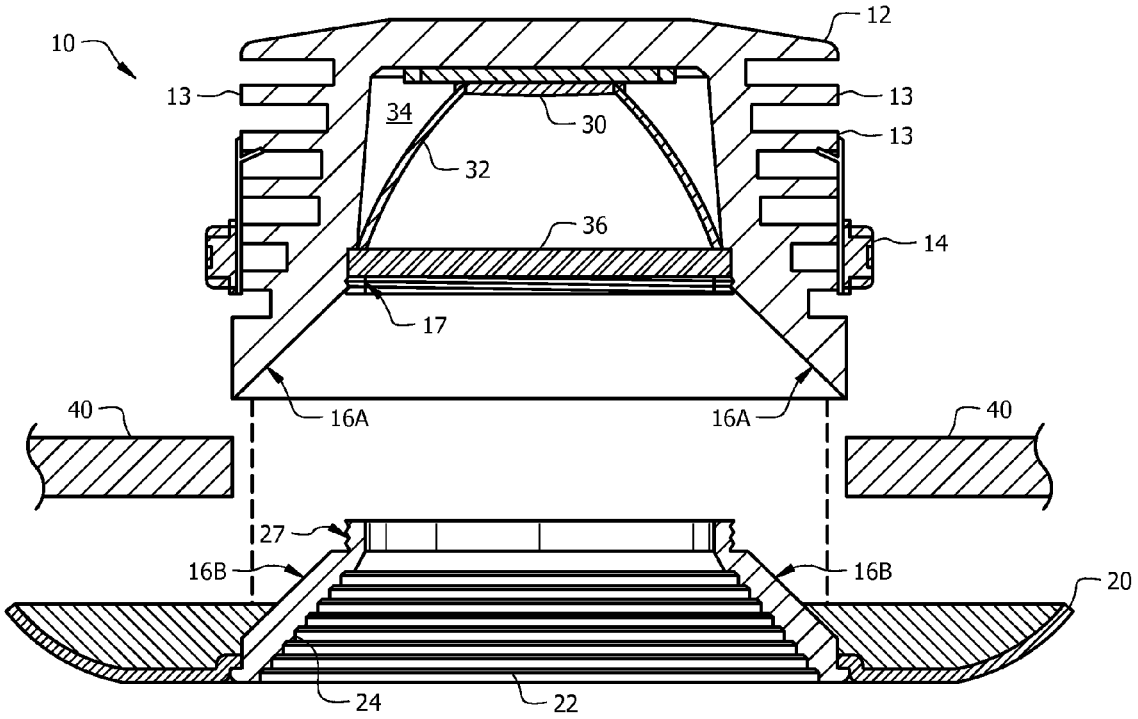
FIG. 5 illustrates a cross-sectional, exploded view of the new LED lighting system.
Figure 6:
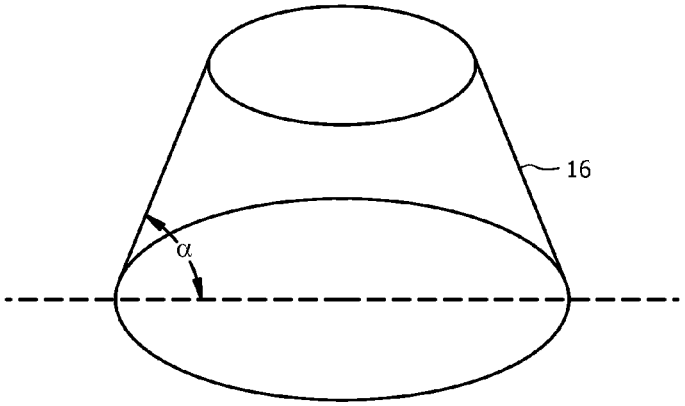
FIG. 6 illustrates a perspective view of the shape of the heat sink to bezel interface of the new LED lighting system.

Referring to FIGS. 4, 5 and 6, an improved LED lighting system 10 is shown. In this exemplary LED lighting system 10, the LED or LED array 30 (or any known or future light source) is mounted within a cavity 34 of a heat sink 12 that also serves as a base, frame, or enclosure.

The typically cylindrically shaped cavity 34 is of appropriate diameter to fit the LED or LED array 30. In one embodiment, the LED or LED array 30 is an array or cluster of LEDs mounted on a metal core board. Several other components of a typical lighting system are shown but are not required in this system, such as, mounting clips 14 to secure the LED lighting system 10 against the ceiling surface 40 (e.g. ceiling tile or drywall). Other optional components include a reflector 32 and a diffuser 36. In such, the reflector 32 redirects light to a desired location and the diffuser typically comprises an acrylic material with a translucent finish to produce a softer lighting effect.

The LED(s) 30 (or other light emitting devices) is/are mechanically mounted to the heat sink 12 providing a thermal resistive path represented by $R\Theta_{jh}$ as shown in FIG. 1. To minimize the thermal resistance and therefore maximize thermal conductivity and thermal transfer between the LED junction and heat sink, heat conductive paste (e.g. heat sink grease) or heat conductive pad material is often placed between the LED(s) 30 and the heat sink 12. In some embodiments, the heat sink 12 includes fins 13 to increase the overall surface area of the heat sink 12, thereby increasing conduction of heat into the dead air space above the ceiling surface 40. The conduction (or radiation) of heat from the heat sink 12 to the dead air space above the ceiling surface 40 is represented by $R\Theta_{hdas}$ as shown in FIG. 1.

The heat sink 12 is made of any suitable material such as aluminum or copper and, optionally, has one or more fins 13 that provide increased surface area for radiation of heat into the area above the ceiling 40.

Heat will only radiate from the base heat sink 12 and optional fins 13 if the temperature of the dead air space, $T_{das}$, is lower than the temperature of the base heat sink 12 (and optional fins 13), $T_h$. For most installations of such lighting systems 10, the ambient temperatures of the dead air space is often too high to provide sufficient heat removal by radiation from the base heat sink 12. Therefore, for many installations, especially during warm seasons, the heat sink 12 and optional fins 13 will not radiate sufficient heat to properly cool the LED(s) 30, resulting in decreased life of the LED(s), improper lighting brightness, undesired color shift, LED failure, etc.

Therefore, it is desirable to remove more heat than is possible with only the base heat sink 12 through either radiation or conduction, especially when the temperature of the dead air space is high.

The lighting system 10 includes a bezel 22 and optional trim 20. The exemplary bezel 22 includes an opening with optional multiple concentric circular groves 24 as a typical example, though any shape and form of bezel 22 and optional trim 20 is anticipated. As an example, the concentric circular grooves 24 provide a certain aesthetic look but also increase thermal radiation by increasing the exposed surface area of the bezel 22, thereby improving heat conduction to the ambient air. Likewise, the trim 20 provides a decorative feature as well as covering the often rough cut opening in the ceiling material 40 and providing an additional sink for heat produced by the LEDs 30.

With incandescent lighting, the bezel 22 and trim 20 was basically decorative, in that, it provides a certain aesthetic look while covering the often rough-cut opening in the ceiling material 40. In the disclosed lighting system, the bezel 22 and optional trim 20 not only provides this same decorative feature, but it also provides an additional sink for heat produced by the LEDs 30, thereby reducing the overall heat of the base heat sink 12 and, consequently, the heat of the LEDs 30.

The bezel 22 has in interface surface 16B. The shape of the interface surface 16B is in the form of a truncated cone or frustum (see FIG. 6). This geometrical shape is like slicing the top of a cone leaving a circular top. In this embodiment, the circular top is an opening to permit the propagation of light from the LED or LED array. The base 12 has a similar interface surface 16A in the form of a similar frustum. Hence, the interface 16 between the interface surface 16B of the bezel 22 and the interface surface 16A the base 12 is a conical frustum. The angle, $\propto$, is any angle between 1 and 89 degrees, though a 45 degree angle is shown.

In one embodiment of the lighting system 10, the bezel 22 is removable from the base 12. The base 12 has snaps or threads 17 and the bezel has mating snaps or threads 27, or any other removable mating system as known in the industry. Many methods exist to secure the bezel 22 to the heat sink base 12. The threaded fitting 17/27, as shown, is one example in which the bezel 22 tightens against the base heat sink 12 through the rotation of the bezel 22. Any system for attaching the bezel 22 to the base heat sink 12 is anticipated including, but not limited to, a press fit or friction fit.

The bezel 22 thermally interfaces to the base 12 in a conical frustum 16 (see FIG. 6). The bezel 22 has an interface surface 16B in the form of a conical frustum that interfaces with an interface surface 16A of the heat sink base 12. The interface surface 16A of the heat sink base is also in the form of a conical frustum of substantially the same size and angle as the interface surface 16B of the bezel 22. The interfaces (16A/16B) are at an angle with respect to the plane of the ceiling 40 and although any angle is anticipated, an angle of approximately 45 degrees is shown. This conical frustum interface method provides an increased surface area for contact between the interface surface 16A of heat sink base 12 and the interface surface 16B of the bezel 22. The increased surface area results in a decrease in the thermal resistance, $R\Theta_{hb}$, and therefore greater heat flow, $Q_{hb}$, from the heat sink 12 to the bezel 22 and optional trim 22. Since more heat $Q_{hb}$ now flows to the bezel, assuming a constant thermal resistance, $R\Theta_{bra}$, for a given material and surface area of the bezel 22 and optional trim 22, more heat flows into the ambient, $Q_{ba}$, thereby providing for improved cooling of the heat sink 12, $Q_t$ and, consequently, the LED(s) 30.

Additionally, because the cavity 34 is exposed to ambient air, further radiation of heat is made possible because the surface area within the cavity 34 also radiates some heat to the ambient air.

Irregularities between the interface surfaces 16A/16B are anticipated as a result of production tolerances. When such irregularities are present, slight air gaps at the interface 16 have the potential of reducing heat flow from the base heat sink 12 to the bezel 22 due to the increased thermal resistance due to gaps within the interface 16 as opposed to direct contact between metals such as aluminum. To mitigate this effect, it is anticipated to include any known thermal interface material such as heat sink grease within the thermal interface 16, thereby further improving the heat conduction characteristics of the thermal interface 16 between the base heat sink 12 and the bezel 22.

The trim 20 is optional, though preferred, providing improved cooling. The trim 20 provides additional surface area that radiates heat into the room ambient air. In some embodiments, trim 20 and bezel 22 are a single piece. In other embodiments, trim 20 and bezel 22 are separate pieces, bonded together or removably bonded together by any means known including, but not limited to, welding, press fit, adhesive, glue, fasteners, etc. When the trim 20 and bezel 22 are separate pieces bonded by a material, it is preferred that the bonding material has a low thermal resistance for a higher thermal conductivity.

The heat sink base 12, bezel 22, and the trim 20 are made of the same or different materials. It is preferred that the materials are thermally conductive materials such as, but not limited to, aluminum or copper. Similar materials will have the same expansion ratios due to heating and help to preserve a tight interface 16 with minimal air gaps.

The exemplary LED lighting system 10 is shown as an example of one possible construction of the disclosed inventions. Any suitable materials are anticipated, beyond that which are disclosed, including aluminum alloys, tin, copper, steel, etc., though aluminum is known to be a cost-effective material with good thermal conduction. Although exemplary LED light sources 30 are used as examples in this disclosure, the lighting system 10 is not limited to only LED light sources and are anticipated for use with any thermally sensitive lighting source either known or a future thermally sensitive light source.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A lighting system comprising:

a base, the base being formed of a material that conducts heat;

means for producing light, the means for producing light mounted to the base, and the means for producing light is thermally interfaced to the base, thereby heat is conducted from the means for producing light to the base; and a bezel, the bezel connected to the base along a conical frustum interface, the conical frustum interface formed at an angle with respect to a lengthwise axis of the bezel such that heat from the base conducts through the conical frustum interface and into the bezel and the heat is radiated from the bezel into room ambient air surrounding the bezel.

2. The lighting system of claim 1, further comprising a trim portion, the trim portion is bonded to the bezel.

3. The lighting system of claim 1, further comprising a trim portion, the trim portion is removably affixed to the bezel.

4. The lighting system of claim 1, further comprising a trim portion, the trim portion is an extension of the bezel.

5. The lighting system of claim 1, wherein the angle is approximately 45 degrees or less.

6. The lighting system of claim 1, wherein the bezel is removably attached to the base.

7. The lighting system of claim 6, wherein the bezel has threads that mate with similar threads in the base.

8. The lighting system of claim 1, wherein the base is made of a material selected from the group of copper, aluminum, aluminum alloys, tin, and steel.

9. The lighting system of claim 1, wherein the base comprises a cavity.

10. A lighting system comprising:

a base, the base being formed of a material that conducts heat;

one or more light emitting diodes (LEDs), the one or more light emitting diodes mounted to the base, and the one or more light emitting diodes thermally interfaced to the base, thereby heat is conducted from the one or more light emitting diodes to the base; and a bezel, the bezel connected to the base along a conical frustum interface, the conical frustum interface formed at an angle with respect to a lengthwise axis of the bezel such that heat from the base conducts through the conical frustum interface and into the bezel and the heat is radiated from the bezel into room ambient air surrounding the bezel.

11. The lighting system of claim 10, further comprising a trim portion, the trim portion is bonded to the bezel.

12. The lighting system of claim 10, further comprising a trim portion, the trim portion is removably affixed to the bezel.

13. The lighting system of claim 10, further comprising a trim portion, the trim portion is an extension of the bezel.

14. The lighting system of claim 10, wherein the angle is approximately 45 degrees or less.

15. The lighting system of claim 10, wherein the bezel is removably attached to the base.

16. The lighting system of claim 15, wherein the bezel has threads that mate with similar threads in the base.

17. The lighting system of claim 10, wherein the base is made of a material selected from the group of copper, aluminum, aluminum alloys, tin, and steel.

18. The lighting system of claim 10, wherein the base comprises a cavity.

19. A method of dissipating heat from a lighting system, the method comprising:

providing the lighting system of claim 10;

providing power to the one or more light emitting diodes, whereby the one or more light emitting diodes produce both light and heat from the power;

conducting at least some of the heat from the light emitting diodes to the base;

conducting at least some heat from the base to the bezel through the conical frustum interface; and conducting/radiating at least some heat from the bezel into the room ambient air surrounding the bezel.

20. The method of claim 19, wherein the lighting system further comprises a trim portion, the trim portion is removably affixed to the bezel, and the method further includes conducting at least some heat from the bezel to the trim portion and conducting/radiating at least some heat from the trim portion into the room ambient air surrounding the trim portion.

21. The method of claim 19, wherein the angle is approximately 45 degrees or less.

22. The method of claim 20, wherein the base, the bezel, and the trim portion are made of materials selected from the group of copper, aluminum, aluminum alloys, tin, and steel.

* * * * *